United States Patent [19]

Ross

[11] 4,183,168

[45] Jan. 15, 1980

[54] FLYING DISK TOY

[76] Inventor: Roger E. Ross, 1015 Sycamore, Iola, Kans. 66249

[21] Appl. No.: 942,211

[22] Filed: Sep. 14, 1978

[51] Int. Cl.[2] ..... A63H 27/12; A63H 27/00

[52] U.S. Cl. ..... 46/60; 46/74 D; 124/5; 124/41 R

[58] Field of Search ..... 46/60, 64, 65, 67, 69, 46/73, 82, 85, 48, 47, 52, 49, 68, 59, 51, 74 D, 43; 273/96 R, 96 B, 97, 112, 116, 128; 124/4, 5, 1, 42, 41 R, 79; 272/25, 8 R, 8 D

[56] References Cited

U.S. PATENT DOCUMENTS

| | | | |
|---|---|---|---|
| 2,098,168 | 11/1937 | Sperry | 46/47 |
| 2,953,378 | 9/1960 | La Veigne, Jr. | 124/5 |
| 2,971,288 | 2/1961 | Gill | 46/67 |
| 3,071,891 | 1/1963 | Stippick | 46/47 |
| 3,141,262 | 7/1964 | Burton | 46/47 |
| 3,589,059 | 6/1971 | Caswell | 46/82 |
| 3,660,929 | 5/1972 | Atkinson | 46/47 |
| 3,673,731 | 4/1972 | Farhi et al. | 46/47 |
| 3,702,191 | 11/1972 | Zilius et al. | 46/43 |
| 3,708,911 | 1/1973 | Haschek | 46/47 |
| 3,813,810 | 6/1974 | Majewski | 46/73 |
| 3,859,748 | 1/1975 | Blue | 46/49 |
| 3,939,601 | 2/1976 | Kernell | 46/47 |
| 4,030,472 | 6/1977 | Watkins | 124/5 |
| 4,096,659 | 6/1978 | Keane | 46/52 |

*Primary Examiner*—Louis G. Mancene
*Assistant Examiner*—Michael J. Foycik
*Attorney, Agent, or Firm*—Robert K. Rhea

[57] ABSTRACT

A circular disk, having opposing flat surfaces, is provided with a spiral groove in one of the flat surfaces for receiving one end of a crank handle and horizontally rotating the disk about its axis and subsequent release of the disk by centrifugal force.

3 Claims, 3 Drawing Figures

FLYING DISK TOY

BACKGROUND OF THE INVENTION

1. Field of the Invention.

The present invention relates to toys and more particularly to a flying disk type toy.

2. Description of the Prior Art.

U.S. Pat. No. 3,589,059 is an example of imparting rotary acceleration to flying disk toys in which a crank, through gears and an inertia mass, imparts an orbiting speed to a disk. U.S. Pat. No. 3,673,731 discloses a gyroscopic type toy in which a disk, having concave/convex surfaces, is rotationally accelerated by twirling a wand on which the disk is balanced. An amusement type toy is disclosed by U.S. Pat. No. 3,702,191 which features a pan-shaped paddle having a spiral raceway formed on convex/concave surfaces for developing skill in maintaining a ball on the raceway.

This invention is distinctive over these patents by providing a spiral groove or raceway in one flat surface of a disk toy for receiving one end of a crank by which rotational acceleration is imparted to the disk to be airborne.

SUMMARY OF THE INVENTION

A circular disk, having opposing flat surfaces, is provided with a spiral groove in one of its flat surfaces, the groove beginning at the axis of the disk and terminating at its marginal edge. A disk launching a crank is provided with a head at one of its ends, the head being loosely received within the spiral groove for supporting the disk when the disk is disposed with its grooved surface downwardly. The crank is provided with a handle at its other end for rotating the crank and disk about the axis of the handle when held vertically for imparting a spinning action to the disk and releasing the spinning disk in a flying action when centrifugal force progressively moves the crank head along the groove path.

The principal object of this invention is to provide a flying disk toy and manually operated crank means for launching the disk in a spinning action.

DESCRIPTION OF THE PREFERRED EMBODIMENT

Figure 2:
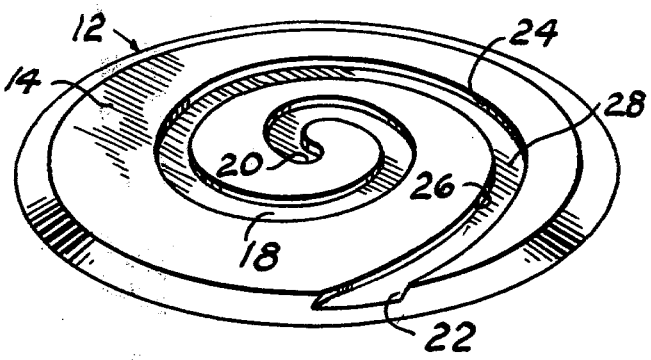
FIG. 2 is a perspective view of the disk, to a larger scale, per se, when inverted from the position shown by FIG. 1; and, FIG. 3 is a perspective view of the disk launching crank.
Figure 3:
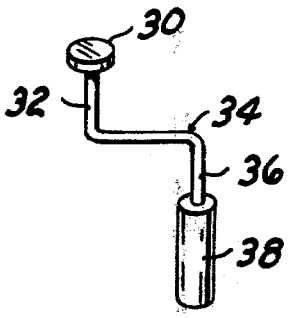
Figure 1:
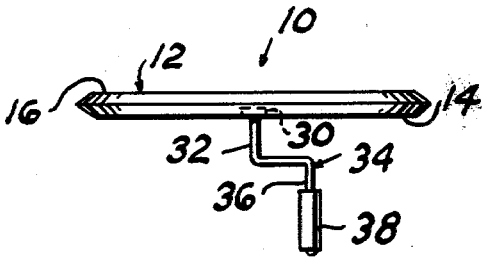
FIG. 1 is an elevational view of the disk and crank in position for launching the disk.

Like characters of reference designate like parts in those figures of the drawings in which they occur.

In the drawings:

The reference numeral 10 indicates a flying disk type toy comprising a disk 12, preferably formed from lightweight material, having a low friction surface and having opposing flat surfaces 14 and 16 which merge at the circumferential edge of the disk. One surface of the disk, for example the surface 14, is provided with a spiral groove or raceway 18 beginning at the axial center of the surface 14, as at 20, and terminating in an exit end 22 at the periphery of the disk after completing at least one complete revolution about the axis of the disk. Transversely the raceway 18 is substantially U-shaped having a depth less than its width defined by opposing side walls 24 and 26 parallel with the axis of the disk and a flat bottom surface 28. The purpose of the raceway is for freely receiving one end of a cylindrical-like head 30, similarly formed from material having a low friction surface, and journalled by one leg portion 32 of a crank 34. The other leg 36 of the crank extends in a direction opposite and parallel with the first named crank leg 32 and has a handle 38 rotatably surrounding and secured thereto.

The disk 12 is launched by manually grasping the handle 38 and disposing the legs 32 and 36 vertically upright and then manually placing the disk thereon with the inner end 20 of the raceway over the head 30. The top flat surface of the head 30, in contiguous contact with the bottom 28 of the raceway, axially supports the disk 12. With the crank handle held upright, the handle and crank is manually rotated in a circular motion so that the handle leg 36 rotates within the handle 38 which imparts a rotational action to the disk about the axis of the crank leg 36 and simultaneously rotates the disk 12 and head 30 about the axis of the crank leg 32. Continued acceleration imparted to the crank 34 increases the rotational speed of the disk until centrifugal force releases the disk from the head by the peripheral edge of the head 30 rolling along the raceway wall 24 until the head separates from the disk at the raceway exit end 22.

Obviously the invention is susceptible to changes or alterations without defeating its practicability. Therefore, I do not wish to be confined to the preferred embodiment shown in the drawings and described herein.

I claim:

1. A flying disk toy, comprising:

a disk having opposing flat surfaces and having an elongated spiral groove formed in one said surface beginning near the center of said disk and terminating at the perimeter of said disk; and, means for launching said disk into the air comprising a crank having a rotatable head at one end coacting with said groove and having a handle journalled by its other end portion.

2. The toy according to claim 1 in which the groove is shallow U-shaped characterized by opposing parallel side walls normal to the axis of the disk and a flat bottom surface normal to said side walls and in which said head is cylindrical.

3. The toy according to claim 2 in which the groove describes at least one complete revolution about the axis of the disk.

* * * * *